US008974559B2

(12) United States Patent
Frushour

(10) Patent No.: US 8,974,559 B2
(45) Date of Patent: Mar. 10, 2015

(54) PDC MADE WITH LOW MELTING POINT CATALYST

(76) Inventor: Robert Frushour, Ann Arbor, MI (US)

( * ) Notice: Subject to any disclaimer, the term of this patent is extended or adjusted under 35 U.S.C. 154(b) by 644 days.

(21) Appl. No.: 13/208,494

(22) Filed: Aug. 12, 2011

(65) Prior Publication Data

US 2012/0285100 A1 Nov. 15, 2012

Related U.S. Application Data

(60) Provisional application No. 61/485,412, filed on May 12, 2011.

(51) Int. Cl.

| | |
|---|---|
| ***B24D 3/02*** | (2006.01) |
| ***B24D 3/18*** | (2006.01) |
| ***E21B 10/567*** | (2006.01) |
| ***E21B 10/573*** | (2006.01) |
| ***B22F 7/06*** | (2006.01) |
| ***C22C 26/00*** | (2006.01) |
| *B22F 5/00* | (2006.01) |

(52) U.S. Cl.

CPC ..... *E21B 10/567* (2013.01); *E21B 10/5735* (2013.01); *B22F 7/064* (2013.01); *C22C 26/00* (2013.01); *B22F 2005/001* (2013.01); *B22F 2999/00* (2013.01)

USPC ..... 51/307

(58) Field of Classification Search

USPC ..... 51/307, 295

See application file for complete search history.

(56) References Cited

U.S. PATENT DOCUMENTS

| | | | |
|---|---|---|---|
| 2,238,351 | A | 4/1941 | Van Der Pyl |
| 2,941,248 | A | 6/1960 | Hall |
| 3,083,080 | A | 3/1963 | Bovenkerk |
| 3,134,739 | A | 5/1964 | Cannon |
| 3,136,615 | A | 6/1964 | Bovenkerk et al. |
| 3,141,746 | A | 7/1964 | De Lai |
| 3,233,988 | A | 2/1966 | Wentorf, Jr. et al. |
| 3,297,407 | A | 1/1967 | Wentorf, Jr. |
| 3,423,177 | A | 1/1969 | Bovenkerk |
| 3,574,580 | A | 4/1971 | Stromberg et al. |
| 3,745,623 | A | 7/1973 | Wentorf, Jr. et al. |
| 4,034,066 | A | 7/1977 | Strong et al. |
| 4,042,673 | A | 8/1977 | Strong |
| 4,073,380 | A | 2/1978 | Strong et al. |
| 4,108,614 | A | 8/1978 | Mitchell |
| 4,124,690 | A | 11/1978 | Strong et al. |
| 4,151,686 | A | 5/1979 | Lee et al. |
| 4,224,380 | A | 9/1980 | Bovenkerk et al. |
| 4,247,304 | A | 1/1981 | Morelock |
| 4,255,165 | A | 3/1981 | Dennis et al. |
| 4,268,276 | A | 5/1981 | Bovenkerk |

(Continued)

FOREIGN PATENT DOCUMENTS

| | | | |
|---|---|---|---|
| EP | 061954 | A1 | 12/1980 |
| EP | 0300699 | A2 | 1/1989 |

(Continued)

*Primary Examiner* — Pegah Parvini

(74) *Attorney, Agent, or Firm* — Young Basile Hanlon & MacFarlane P.C.

(57) ABSTRACT

PDC is made using a solvent catalyst that has a melting point below that of the cobalt which is used to cement the tungsten carbide supporting substrate. The lower melting temperature allows control of the amount of catalyst that remains in the interstices after HPHT sintering since the process can be done without melting the cobalt in the substrate which would flow into and completely fill the pore volume of the diamond mass.

3 Claims, 2 Drawing Sheets

(56) References Cited

U.S. PATENT DOCUMENTS

| | | | |
|---|---|---|---|
| 4,303,442 | A | 12/1981 | Hara et al. |
| 4,311,490 | A | 1/1982 | Bovenkerk et al. |
| 4,373,593 | A | 2/1983 | Phaal et al. |
| 4,387,287 | A | 6/1983 | Marazzi |
| 4,412,980 | A | 11/1983 | Tsuji et al. |
| 4,481,016 | A | 11/1984 | Campbell et al. |
| 4,486,286 | A | 12/1984 | Lewin et al. |
| 4,504,519 | A | 3/1985 | Zelez |
| 4,522,633 | A | 6/1985 | Dyer |
| 4,525,179 | A | 6/1985 | Gigl |
| 4,534,773 | A | 8/1985 | Phaal et al. |
| 4,556,407 | A | 12/1985 | Fecik et al. |
| 4,560,014 | A | 12/1985 | Geczy |
| 4,570,726 | A | 2/1986 | Hall |
| 4,572,722 | A | 2/1986 | Dyer |
| 4,604,106 | A | 8/1986 | Hall et al. |
| 4,605,343 | A | 8/1986 | Hibbs, Jr. et al. |
| 4,606,738 | A | 8/1986 | Hayden |
| 4,621,031 | A | 11/1986 | Scruggs |
| 4,636,253 | A | 1/1987 | Nakai et al. |
| 4,645,977 | A | 2/1987 | Kurokawa et al. |
| 4,662,348 | A | 5/1987 | Hall et al. |
| 4,664,705 | A | 5/1987 | Horton et al. |
| 4,707,384 | A | 11/1987 | Schachner et al. |
| 4,726,718 | A | 2/1988 | Meskin et al. |
| 4,766,040 | A | 8/1988 | Hillert et al. |
| 4,776,861 | A | 10/1988 | Frushour |
| 4,792,001 | A | 12/1988 | Zijsling |
| 4,793,828 | A | 12/1988 | Burnand |
| 4,797,241 | A | 1/1989 | Peterson et al. |
| 4,802,539 | A | 2/1989 | Hall et al. |
| 4,807,402 | A | 2/1989 | Rai |
| 4,828,582 | A | 5/1989 | Frushour |
| 4,844,185 | A | 7/1989 | Newton, Jr. et al. |
| 4,861,350 | A | 8/1989 | Phaal et al. |
| 4,871,377 | A | 10/1989 | Frushour |
| 4,899,922 | A | 2/1990 | Slutz et al. |
| 4,919,220 | A | 4/1990 | Fuller et al. |
| 4,940,180 | A | 7/1990 | Martell |
| 4,943,488 | A | 7/1990 | Sung et al. |
| 4,944,772 | A | 7/1990 | Cho |
| 4,976,324 | A | 12/1990 | Tibbitts |
| 5,011,514 | A | 4/1991 | Cho et al. |
| 5,027,912 | A | 7/1991 | Juergens |
| 5,030,276 | A | 7/1991 | Sung et al. |
| 5,092,687 | A | 3/1992 | Hall |
| 5,116,568 | A | 5/1992 | Sung et al. |
| 5,127,923 | A | 7/1992 | Bunting et al. |
| 5,133,332 | A | 7/1992 | Tanaka et al. |
| 5,135,061 | A | 8/1992 | Newton, Jr. |
| 5,176,720 | A | 1/1993 | Martell et al. |
| 5,186,725 | A | 2/1993 | Martell et al. |
| 5,199,832 | A | 4/1993 | Meskin et al. |
| 5,205,684 | A | 4/1993 | Meskin et al. |
| 5,213,248 | A | 5/1993 | Horton et al. |
| 5,236,674 | A | 8/1993 | Frushour |
| 5,238,074 | A | 8/1993 | Tibbitts et al. |
| 5,244,368 | A | 9/1993 | Frushour |
| 5,264,283 | A | 11/1993 | Waldenstrom et al. |
| 5,337,844 | A | 8/1994 | Tibbitts |
| 5,370,195 | A | 12/1994 | Keshavan et al. |
| 5,379,853 | A | 1/1995 | Lockwood et al. |
| 5,439,492 | A | 8/1995 | Anthony et al. |
| 5,451,430 | A | 9/1995 | Anthony et al. |
| 5,464,068 | A | 11/1995 | Najafi-Sani |
| 5,468,268 | A | 11/1995 | Tank et al. |
| 5,496,638 | A | 3/1996 | Waldenstrom et al. |
| 5,505,748 | A | 4/1996 | Tank et al. |
| 5,510,193 | A | 4/1996 | Cerutti et al. |
| 5,523,121 | A | 6/1996 | Anthony et al. |
| 5,524,719 | A | 6/1996 | Dennis |
| 5,560,716 | A | 10/1996 | Tank et al. |
| 5,607,024 | A | 3/1997 | Keith et al. |
| 5,620,382 | A | 4/1997 | Cho et al. |
| 5,624,068 | A | 4/1997 | Waldenstrom et al. |
| 5,667,028 | A | 9/1997 | Truax et al. |
| 5,672,395 | A | 9/1997 | Anthony et al. |
| 5,718,948 | A | 2/1998 | Ederyd et al. |
| 5,722,499 | A | 3/1998 | Nguyen et al. |
| 5,776,615 | A | 7/1998 | Wong et al. |
| 5,833,021 | A | 11/1998 | Mensa-Wilmot et al. |
| 5,855,996 | A | 1/1999 | Corrigan et al. |
| 5,897,942 | A | 4/1999 | Karner et al. |
| 5,921,500 | A | 7/1999 | Ellis et al. |
| 5,954,147 | A | 9/1999 | Overstreet et al. |
| 5,981,057 | A | 11/1999 | Collins |
| 6,009,963 | A | 1/2000 | Chaves et al. |
| 6,030,595 | A | 2/2000 | Sumiya et al. |
| 6,050,354 | A | 4/2000 | Pessier et al. |
| 6,063,333 | A | 5/2000 | Dennis |
| 6,123,612 | A | 9/2000 | Goers |
| 6,126,741 | A | 10/2000 | Jones et al. |
| 6,202,770 | B1 | 3/2001 | Jurewicz et al. |
| 6,248,447 | B1 | 6/2001 | Griffin et al. |
| 6,269,894 | B1 | 8/2001 | Griffin |
| 6,298,930 | B1 | 10/2001 | Sinor et al. |
| 6,344,149 | B1 | 2/2002 | Oles |
| 6,401,845 | B1 | 6/2002 | Fielder |
| 6,443,248 | B2 | 9/2002 | Yong et al. |
| 6,443,249 | B2 | 9/2002 | Beuershausen et al. |
| 6,460,631 | B2 | 10/2002 | Dykstra et al. |
| 6,544,308 | B2 | 4/2003 | Griffin et al. |
| 6,562,462 | B2 | 5/2003 | Griffin et al. |
| 6,582,513 | B1 | 6/2003 | Linares et al. |
| 6,585,064 | B2 | 7/2003 | Griffin et al. |
| 6,589,640 | B2 | 7/2003 | Griffin et al. |
| 6,592,985 | B2 | 7/2003 | Griffin et al. |
| 6,601,662 | B2 | 8/2003 | Matthias et al. |
| 6,681,098 | B2 | 1/2004 | Pfenninger et al. |
| 6,739,214 | B2 | 5/2004 | Griffin et al. |
| 6,749,033 | B2 | 6/2004 | Griffin et al. |
| 6,797,326 | B2 | 9/2004 | Griffin et al. |
| 6,811,610 | B2 | 11/2004 | Frushour et al. |
| 6,846,341 | B2 | 1/2005 | Middlemiss |
| 6,852,414 | B1 | 2/2005 | Frushour |
| 6,861,137 | B2 | 3/2005 | Griffin et al. |
| 6,878,447 | B2 | 4/2005 | Griffin et al. |
| 7,000,715 | B2 | 2/2006 | Sinor et al. |
| 7,070,635 | B2 | 7/2006 | Frushour |
| 7,316,279 | B2 | 1/2008 | Wiseman et al. |
| 7,517,588 | B2 | 4/2009 | Frushour |
| 7,595,110 | B2 | 9/2009 | Frushour |
| 7,757,791 | B2 | 7/2010 | Belnap et al. |
| 2005/0115744 | A1 | 6/2005 | Griffin et al. |
| 2008/0115421 | A1 | 5/2008 | Sani |
| 2008/0223623 | A1 | 9/2008 | Keshavan et al. |
| 2009/0152018 | A1 | 6/2009 | Sani |
| 2009/0260895 | A1* | 10/2009 | Vail et al. ..... 175/434 |
| 2010/0032006 | A1 | 2/2010 | Basol |
| 2011/0083908 | A1 | 4/2011 | Shen et al. |
| 2011/0266070 | A1* | 11/2011 | Scott et al. ..... 175/428 |

FOREIGN PATENT DOCUMENTS

| | | | |
|---|---|---|---|
| EP | 0329954 | A2 | 8/1989 |
| EP | 0462091 | A1 | 12/1991 |
| EP | 0462955 | A1 | 12/1991 |
| EP | 0480895 | A2 | 4/1992 |
| EP | 0500253 | A1 | 8/1992 |
| EP | 0595630 | A1 | 5/1994 |
| EP | 0595631 | A1 | 5/1994 |
| EP | 0612868 | A1 | 8/1994 |
| EP | 0617207 | A2 | 9/1994 |
| EP | 0671482 | A1 | 9/1995 |
| EP | 0787820 | A2 | 8/1997 |
| EP | 0860515 | A1 | 8/1998 |
| EP | 1190791 | A2 | 3/2002 |
| EP | 2048927 | A2 | 4/2009 |
| GB | 2048927 | A | 12/1980 |
| GB | 2261894 | A | 6/1993 |
| GB | 2268768 | A | 1/1994 |
| GB | 2323110 | A | 9/1998 |
| GB | 2323398 | A | 9/1998 |
| JP | 59219500 | A | 12/1984 |

(56) References Cited

FOREIGN PATENT DOCUMENTS

| | | | |
|---|---|---|---|
| WO | 9323204 | A1 | 11/1993 |
| WO | 9634131 | A1 | 10/1996 |
| WO | 0028106 | A1 | 5/2000 |
| WO | 2004022821 | A1 | 3/2004 |

* cited by examiner

PDC MADE WITH LOW MELTING POINT CATALYST

CROSS REFERENCE TO COPENDING APPLICATION

This application claims priority benefit of the U.S. Provisional Application Ser. No. 61/485,412 filed on May 12, 2011 in the name of R. Frushour, the entire contents which are incorporated herein by reference.

BACKGROUND

1. Field of the Invention

The present invention relates to a sintered polycrystalline diamond composite for use in rock drilling, machining of wear resistant materials, and other operations which require the high abrasion resistance or wear resistance of a diamond surface. Specifically, this invention relates to such bodies that include a polycrystalline diamond layer attached to a cemented carbide substrate via processing at ultrahigh pressures and temperatures.

2. Description of the Art

It is well known in the art to form a polycrystalline diamond cutting element by sintering diamond particles into a compact using a high pressure, high temperature (HP/HT) press and a suitable catalyst sintering aid. Apparatus and techniques to accomplish the necessary sintering of the diamond particles are disclosed in U.S. Pat. No. 2,941,248 to Hall and U.S. Pat. No. 3,141,746 to DeLai.

U.S. Pat. No. 3,745,623 Wentorf et al. teaches sintering of the diamond mass in conjunction with tungsten carbide to produce a composite compact (PDC) in which the diamond particles are bonded directly to each other and to a cemented carbide substrate.

Diamond compacts and PDC manufactured in accordance with the teachings of DeLai and Wentorf et al. have been limited to low-temperature applications since they show significant thermal damage at temperatures above approximately 750° C. The thermal degradation results in accelerated wear when such compacts are employed in high-temperature applications such as in rock drilling.

A solution to this problem has been proposed in U.S. Pat. No. 5,127,923 to Bunting whereby a diamond cutting element is produced by subjecting a mass of abrasive particles, e.g. diamond or cubic born nitride, to multiple pressure cycles at high temperatures. A solvent-catalyst sintering aid is employed in the initial pressure cycle to form a compact. Depending upon the degree of sintering, the solvent-catalyst can be removed by leaching or other suitable process. During a second pressure cycle, the compact can be bonded to a supporting substrate. In addition, a non-catalyst sintering aid, such as silicon, boron or metals rendered non-catalytic by the addition of silicon or boron which may form strong and chemically-resistant carbides, can be used in the second pressure cycle to enhance the sintering process and create a hard abrasive bonding matrix through out the particle mass.

A problem with this approach is that the polycrystalline diamond layer that is formed during the first high-pressure/high-temperature cycle must be precision ground prior to placing it on top of a substrate for the final high-pressure/high-temperature bonding step. This significantly increases the cost and results in a significantly lower yield than producing PDC in a single step operation. Another disadvantage is the bond between the polycrystalline diamond layer and the substrate is not nearly as strong as that for PDC which is made in a single high pressure cycle whereby individual diamond crystals are bonded to a substrate and to each other. The diamond layer on PDC made by this prior art method often spontaneously delaminates from the substrate before or during use on drill bits or other tools.

Another solution to this problem has been proposed in U.S. Pat. Nos. 6,878,447, 6,861,137, 6,861,098, 6,797,326, 6,739,214, 6,592,985, 6,589,640, 6,562,462 and 6,544,308 to Griffin. This solution provides a cutting element wherein a portion of the diamond table is substantially free of the catalyzing material, and the remaining diamond matrix contains the catalyzing material.

According to these patents, a portion of the diamond table of the PCD element is post-processed so that the interstices among the diamond crystals are substantially free of the catalyzing material. The portion of the diamond table that is substantially free of the catalyzing material is not subject to the thermal degradation encountered in other areas of the diamond body, resulting in improved resistance to thermal degradation. In cutting elements, the processed portion of the diamond body may be a portion of the facing table of the body, a portion of the peripheral surface of the body, or portions of all these surfaces.

A problem with this approach is that it is difficult to leach the catalyst sintering aid if the polycrystalline diamond working surface is highly consolidated with strong diamond to diamond bonding. Typically PDC for rock drilling is made from a blend of diamond with different particle sizes giving an average particle size of less than 25 microns. This results in a dense diamond table and it is very difficult to remove the catalyst. Even with diamond particle sizes as large as 40 microns it can become problematic to remove the catalyst if sintering conditions are such that extensive diamond to diamond bonding reduces the size of the interconnected pore network. To alleviate this problem, addition of non-catalytic fillers or lower pressure sintering conditions are necessary in order to create a large enough area of interconnected pores so that acids or other materials can effectively penetrate the diamond network to remove the catalyst. This reduces the impact and abrasion resistance of the finished PDC.

It is desirable to produce a more thermally stable PDC without having to go through the time consuming and costly steps of having to leach out the solvent catalyst from a densely formed and well bonded diamond layer.

SUMMARY

A cutting element includes a bonded diamond layer attached to a substrate at an interface. The diamond is bonded together in the diamond layer and the diamond layer is bonded to the substrate using a catalyst that has a melting point below that of a bonding aid used to form the substrate. The amount of catalyst used has less volume than the volume of an available pore network in the diamond layer. The diamond layer is sintered and attached to the substrate at a temperature below that which would cause the bonding aid in the substrate to flow into the pore network in the diamond layer substantially filling all of the pores in the pore network in the diamond layer.

The bonded diamond layer can be formed of individual diamond crystals and/or PPDA.

A method of manufacturing a cutting element includes the steps of:

attaching a bonded diamond layer to a substrate at an interface using a catalyst that has a melting point below that of a bonding aid used to form the substrate;

using an amount of catalyst to bond the diamond in the diamond layer together and to bond the diamond layer to the substrate having less volume than a volume of an available pore network formed in the diamond layer;

sintering the diamond layer and attaching the diamond layer to the substrate at a temperature below that which would cause the bonding aid of the substrate to flow into the pore network in the diamond layer substantially filling all the pores in the pore network.

The diamond layer maybe formed of individual diamond crystals.

The diamond layer may be formed of individual diamond crystals and/or PPDA.

DESCRIPTION OF THE DRAWING

The various features, advantages and other uses of the present PDC made with low melting point catalyst will become more apparent by referring to the following detailed description and drawing in which.

DETAILED DESCRIPTION

Figure 1:
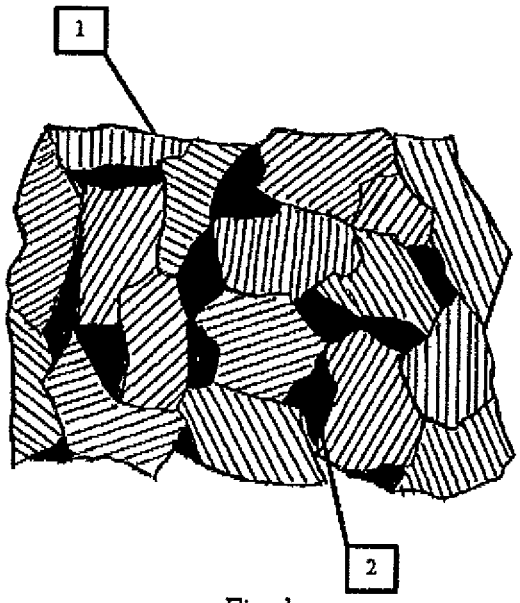
FIG. 1 is a representation of a portion of the diamond table of a PDC made according to the prior art showing the network of interconnected pores filled with catalyst metal.

Conventional PDC is made by sintering a diamond mass together and attaching it to a substrate using cobalt as a sintering aid. Generally, the cobalt is supplied from the cobalt cemented tungsten carbide substrate. This catalyst melts then sweeps through the empty interconnected network of pores in the diamond layer filling the pores and sintering the mass. After bringing the PDC to ambient conditions, the catalyst remains in the pore network and, upon reheating the PDC, it can cause significant damage to the structural integrity of the diamond layer. FIG. 1 shows a portion of the diamond layer 1 of a conventional prior art PDC that has catalyst metal in the pore network 2.

Figure 2:
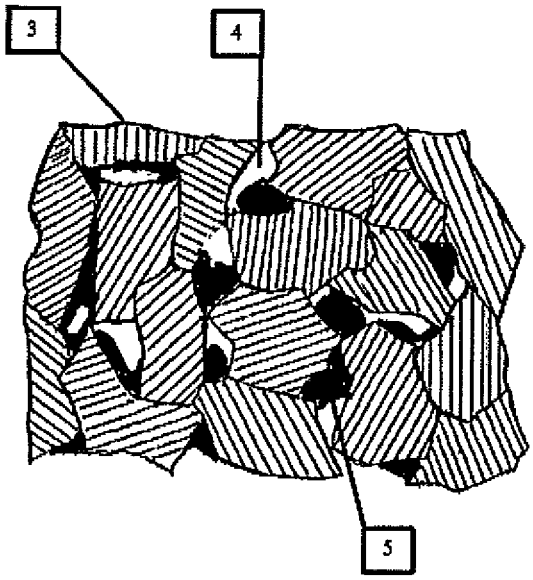
FIG. 2 is a representation of a portion of a diamond table of a PDC made according to aspects of this invention showing the network of interconnected pores partially filled with catalyst metal.

According to the aspects of this invention, the amount of retained catalyst in the pore network can be controlled by using a catalyst that has a lower melting point than that of the cobalt in the substrate. The PDC is sintered at the temperature of the lower melting catalyst and the catalyst forms an alloy with the cobalt at the interface between the diamond and the substrate. Thus, the PDC is formed without melting the cobalt in the substrate so the amount of catalyst retained in the pore network of the diamond layer is controlled by how much catalyst is added to bond the diamond. If individual crystals of diamond are used to form the layer, the pore volume can be determined or estimated so that not enough catalyst is added to completely fill the pore network. FIG. 2 is an illustration of a portion of the diamond table 3 in which only part of the pore network 4 is filled with catalyst 5.

Since the majority of wear to a PDC is caused by the thermal expansion of the catalyst metal stressing the bonded diamond, the reduced amount of catalyst retained in the diamond layer by following the aspects of this invention results in a more wear resistant PDC.

At very high temperatures in the interface between the cutting edge of the PDC and the rock while drilling, the retained catalyst can cause back conversion of diamond to graphite which again reduces the wear capability of the PDC. So a reduced amount of catalyst in the diamond layer also aids in retarding this type of wear activity.

Figure 3:
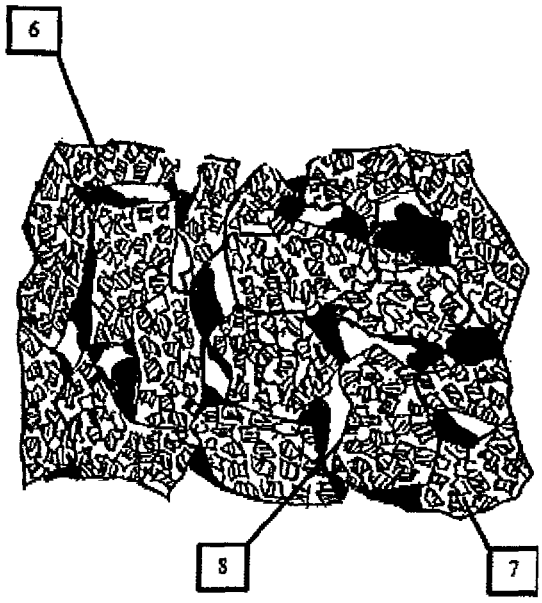
FIG. 3 is a representation of a portion of the diamond layer of a PDC made according to aspects of this invention wherein PPDA are used in place of single diamond crystals and additional empty pore space is made available to wick away the catalyst used to sinter the diamond table.

A PDC can be made according to aspects of this invention using individual diamond crystals as the starting material for the diamond layer or a presintered diamond layer can be attached to a substrate with the lower melting catalyst. Alternately, presintered polycrystalline diamond agglomerates (PPDA) can be used in place of individual diamond crystals. An advantage of using PPDA is that they can be leached removing the retained catalyst and providing an additional empty pore network to wick away the catalyst used to bond the PDA together during the PDC HPHT manufacturing step. FIG. 3 shows PPDA 6 used in place of single crystals. The pore network 7 of the PPDA can be used to wick the catalyst away from the interfaces 8 being sintered during the HPHT manufacturing step of the PDC.

Figure 4:
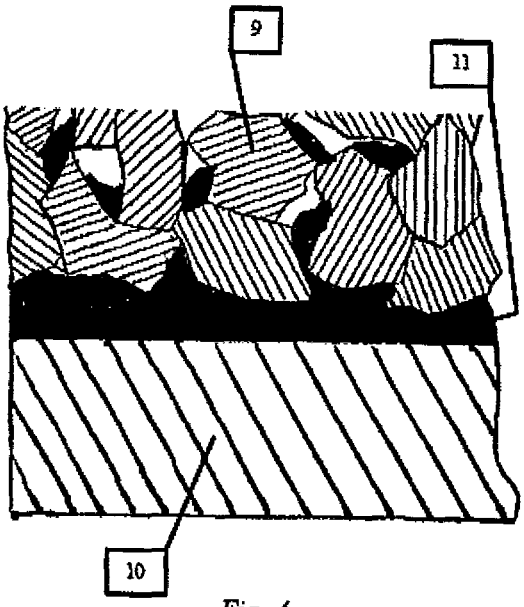
FIG. 4 is an illustration of an area showing the interface between the diamond layer and the substrate for a PDC made according to the aspects of this invention.

Examples of low melting catalysts which can be used to sinter the diamond layer are iron nickel alloys, such as INVAR™. This alloy will also alloy with cobalt to provide a strong bond to the substrate. Care must be taken during PDC manufacture to keep the HPHT step of a short enough duration so that the sintering catalyst alloy does not alloy completely with the cobalt; otherwise enough metal becomes available to completely fill the pore network defeating the purpose for using the low melting catalyst. FIG. 4 illustrates the interface of the diamond and the substrate wherein the catalyst used to sinter the diamond 9 alloys with the cobalt from the substrate 10 to form the bond 11.

Many other solvent metal catalysts described in the prior art can be used that have lower melting points than cobalt. The wider the separation of the melting points, the easier it is to control the processing conditions so that the temperature stays below that which would cause the cobalt or other bonding aid of the substrate to flow into the pore network between the diamond crystals.

The invention claimed is:

1. A method of manufacturing a cutting element comprising the steps of:

attaching a bonded diamond layer to a substrate at an interface using a catalyst that has a melting point below that of a bonding aid used to form the substrate;

using an amount of the catalyst to bond the diamonds in the diamond layer together and to bond the diamond layer to the substrate having less volume than a volume of an available pore network formed in the diamond layer;

sintering the diamond layer and attaching the diamond layer to the substrate at a temperature below that which would cause the bonding aid of the substrate to flow into the pore network in the diamond layer substantially filling all the pores in the pore network.

2. The method of claim 1 further comprising the step of:

forming the bonded diamond layer of the individual diamond crystals.

3. The method of claim 1 further comprising the step of:

forming the bonded diamond layer of polycrystalline diamond agglomerate.

* * * * *